United States Patent [19]

Nishikawa

[11] Patent Number: 5,005,561

[45] Date of Patent: Apr. 9, 1991

[54] INSTRUMENT FOR SKIN-STIMULATING THERAPY

[76] Inventor: Kiyoshi Nishikawa, 2-6-19, Nakane, Meguro-ku, Tokyo, Japan

[21] Appl. No.: 304,761

[22] Filed: Jan. 31, 1989

[30] Foreign Application Priority Data

Feb. 3, 1988 [JP] Japan ..... 63-13444

[51] Int. Cl.[5] ..... A61H 15/00

[52] U.S. Cl. ..... 128/60; 128/57; 128/67

[58] Field of Search ..... 128/57, 25 B, 67, 60 R, 128/60

[56] References Cited

U.S. PATENT DOCUMENTS

| | | | |
|---|---|---|---|
| 1,710,051 | 4/1929 | Giacopazzi | 128/57 |
| 1,757,004 | 5/1930 | Chapin | 128/57 |
| 1,824,920 | 9/1931 | Novak | 128/57 |
| 2,007,737 | 7/1935 | Anderson | 128/57 |
| 2,572,627 | 10/1951 | Kelly | 128/57 |
| 2,578,916 | 12/1951 | Belleville | 128/57 |
| 2,599,367 | 6/1952 | Brucato | 128/57 |
| 3,060,928 | 10/1962 | Lowe | 128/57 |
| 3,756,224 | 9/1973 | Laymon | 128/57 |
| 3,970,078 | 7/1976 | Rogers | 128/57 |
| 4,205,663 | 6/1980 | Fujiwara | 128/57 |
| 4,622,956 | 11/1986 | Nesheim | 128/57 |

*Primary Examiner*—Edgar S. Burr
*Assistant Examiner*—Lisa E. Malvaso
*Attorney, Agent, or Firm*—Darby & Darby

[57] ABSTRACT

An instrument for use in a skin-stimulating therapy which includes at least one assembly of a plurality of skin-stimulating toothed wheels arranged in parallel relationship with each other, each toothed wheel having a same diameter and a same tooth shape and a casing for pivotally supporting said assembly to allow independent rotation of the toothed wheels, said assembly of the toothed wheels partly projecting outwardly of the casing to constitute a skin-stimulating acupuncturing assembly.

6 Claims, 2 Drawing Sheets

INSTRUMENT FOR SKIN-STIMULATING THERAPY

BACKGROUND OF THE INVENTION

1. Field of the Invention

The present invention relates to an instrument for use in a skin-stimulating therapy which stimulates a point of a human skin to achieve high effects in curing various diseases and, particularly, it relates to an instrument for use in a so-called roulette therapy which has been recently found to be remarkably effective in curing diseases.

2. Description of the Related Art

In an oriental medical science, the skin-stimulating therapy has been heretofore employed as one of acupuncture treatments, with high curing effect in an allergic disease or the like. Recently, a so-called roulette therapy in which a roulette for sewing operation is used to stimulate a human skin has come to attract public attention. The roulette therapy is a treatment in which the roulette is rolled on the human skin to achieve the same curing effect as in the conventional acupuncture treatment. This treatment can be safely and easily applied and can achieve an effective curing effect in reliable manner, and it has high curing effect in treatment of allergic disease such as nasitis, asthma or other diseases.

The instrument for use in such roulette therapy is a roulette which has been usually employed in sewing operation in a household and such roulette is rolled on the human skin to stimulate points on the human skin to achieve the curing effect. This type of the instrument for skin-stimulating therapy is made of a single toothed wheel including teeth each having a predetermined sharpness. Accordingly, it is impossible to apply stimulation over a wide range of the human skin. Furthermore, it tends to apply excessively high stimulation or excessively low stimulation, depending on a part of the skin on which the roulette is rolled.

OBJECT OF THE INVENTION

It is a general object of the present invention to eliminate the above-mentioned disadvantages of the conventional skin-stimulating therapy.

It is a specific object of the present invention to provide an instrument for use in a skin-stimulating therapy which can apply stimulation over a wide range of a human skin at a time.

It is another object of the present invention to provide an instrument for use in a skin-stimulating therapy which can change sharpness of teeth, depending upon a part of the skin to be stimulated, thereby applying an optimum stimulation onto the part of the skin to be stimulated.

SUMMARY OF THE INVENTION

With the objects as described above, the present invention provides an instrument for a skin-stimulating therapy which comprises an assembly of a plurality of skin-stimulating toothed wheels arranged in parallel relationship with each other, each of said toothed wheels having a same diameter and a same tooth shape, and a casing for pivotally supporting said assembly of the toothed wheels to allow independent rotation of the toothed wheels, said assembly of the toothed wheels partly projecting outwardly of said casing to constitute a skin-stimulating acupuncturing assembly.

The present invention further provides an instrument for a skin-stimulating therapy which comprises a plurality of assemblies of a plurality of skin-stimulating toothed wheels arranged in parallel with each other, each of said toothed wheels having a same diameter and a same tooth shape and a casing for pivotally supporting said assemblies of the toothed wheels at spaced apart positions along a periphery of said casing to allow independent rotation of the toothed wheels, said assemblies of the toothed wheels partly projecting outwardly of the casing to constitute a plurality of skin-stimulating acupuncturing assemblies.

The present invention further provides an instrument for a skin-stimulating therapy of the type as described above, which includes a plurality of assemblies of a plurality of skin-stimulating toothed wheels, in which the tooth shape of the toothed wheels included in one assembly is different from the tooth shape of the toothed wheels included in the other assembly.

The skin-stimulating toothed wheel is prepared by forming a tooth wheel blank from a thin plate of hard material having a desired thickness, sandwiching said toothed wheel blank between a pair of disc-shaped members, each having a desired thickness, and then spot-welding the sandwiched assembly to form a skin-stimulating toothed wheel having a desired combined thickness.

When the instrument for the skin-stimulating therapy as described above is used, the skin-stimulating assembly is pressed onto a human skin and rolled in the forward and backward directions, thereby applying the stimulation to the skin until the skin turns red. Thus, circulation of the blood is promoted and the points on the skin are subjected to the stimulation, whereby a superior curing effect can be achieved. The toothed wheel assembly consists of a plurality of toothed wheels combined together, so that the instrument can apply the stimulation over a relatively wide range of the skin. In the case where a plurality of assemblies are arranged in the casing, wider range of the skin is subjected to the stimulation. In the case where the tooth shape of one assembly is different from the tooth shape of the other assembly, it is possible to select a suitable tooth shape to apply optimum stimulation, depending upon a part of a skin to be stimulated.

DETAILED DESCRIPTION OF THE PREFERRED EMBODIMENT

Figure 1:
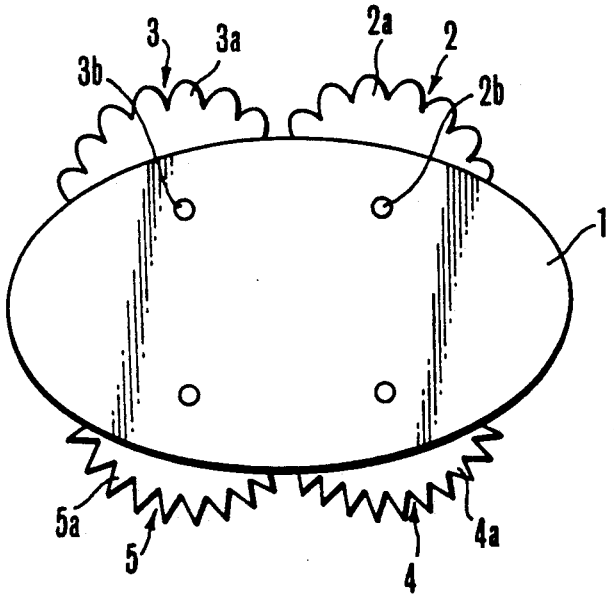
FIG. 1 is a side view showing a first embodiment of the instrument according to the present invention.

The invention will be described with reference to the preferred embodiments illustrated in the drawings.

Figure 2:
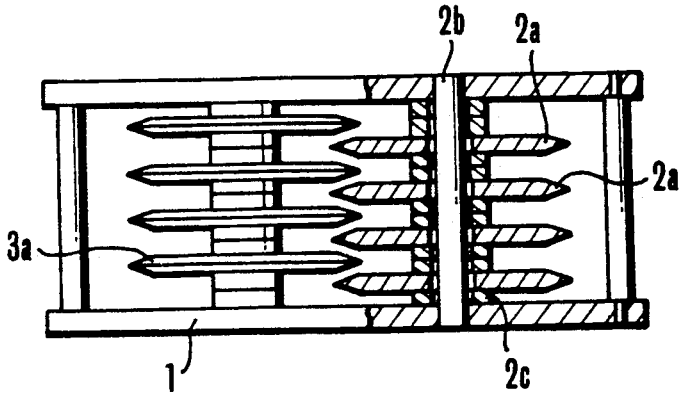
FIG. 2 is a sectional view of the same.

FIGS. 1 and 2 illustrate a first embodiment of the instrument for skin-stimulating therapy according to the present invention.

The instrument includes a casing 1 and toothed-wheel assemblies 2 and 3. The toothed-wheel assembly 2 consists of a plurality of skin-stimulating toothed wheels 2*a* arranged in parallel relationship with each other, each of said toothed wheels having a same diameter and a same tooth shape. These toothed wheels are pivotally supported in the casing 1 by means of a pivot shaft 2*b* in such manner that each toothed wheel is rotatable independently of the other toothed wheels. The toothed wheel assembly partly projects outwardly of the casing, thereby constituting a skin-stimulating acupuncturing assembly. The respective toothed wheels 2*a* are held apart at proper distances by means of spacers 2*c*.

The toothed wheel assembly 3 consists of a plurality of skin-stimulating toothed wheels 3*a*, in the same manner, and they are pivotally supported in the casing 1 by means of a pivot shaft 3*b* in such manner that each toothed wheel is rotatable independently of the other toothed wheel. The toothed wheel assembly partly projects outwardly of the casing, thereby constituting another skin-stimulating acupuncturing assembly.

The toothed wheel assemblies 2 and 3 are arranged in spaced apart relation along a periphery of the casing 1. The toothed wheels of the assemblies 2 and 3 have a same tooth shape. Accordingly, these assemblies 2 and 3 can be simultaneously pressed onto the human skin and rolled to the forward and backward, to achieve the desired curing effect.

In the embodiment as shown in FIG. 1, other two sets of toothed wheel assemblies 4 and 5 are arranged at an opposite side of the casing 1. The toothed wheels 4*a* and 5*a* of these assemblies 4 and 5 have a tooth shape of different sharpness from that of the toothed wheels 2*a* and 3*a* of the assemblies 2 and 3.

When the instrument is used, the toothed wheels 2, 3 or 4, 5 can be selected, as desired, depending upon the stimulation to be applied to the part of the skin.

Figure 3:
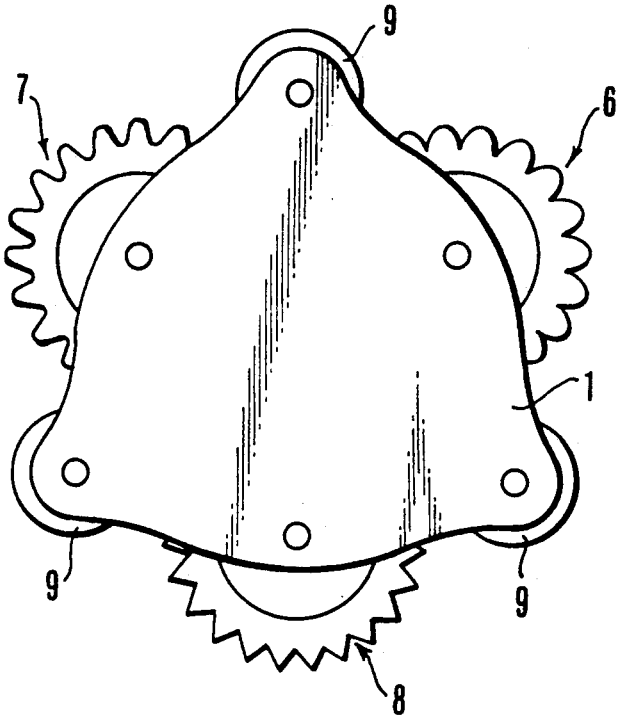
FIG. 3 is a side view showing a second embodiment of the present invention.

FIG. 3 illustrates a second embodiment of the instrument according to the present invention. The embodiment of FIG. 3 has no essential difference from that of FIG. 1, except that the casing 1 is formed in a substantially triangular shape and toothed wheel assemblies 6, 7 and 8 similar to the above-described toothed wheel assembly are disposed at central positions of three sides of the triangular shape. The skin-stimulating toothed wheels of these assemblies have different tooth shapes with different sharpness, respectively. When use, any assembly having a desired sharpness can be selected, depending upon the part of the skin to be stimulated. Stabilizing roller 9 is arranged at each apex of the triangular shape, which serves to stabilize the instrument when it is applied to the skin and rolled thereon.

In the above case, it is required to prepare a plurality of skin-stimulating toothed wheels having different sharpness but it is not easy to produce such toothed wheels at low cost. Now the method of preparing such toothed wheel at low cost will be explained.

Figure 4:
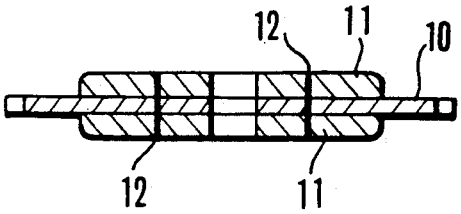
FIG. 4 is a sectional view showing a skin-stimulating toothed wheel.

Referring to FIG. 4, such toothed wheel can be prepared by forming a toothed wheel blank 10 from a hard material, such as stainless steel having thickness of 0.5 mm, 0.3 mm, 0.2 mm or the like, disposing a pair of metallic disc-shaped members 11 having desired thickness on both sides of said toothed wheel blank to form a sandwiches construction of the tooth wheel blank and the metallic disc-shaped members and then spot welding this sandwich construction at 12. In this method, the skin-stimulating toothed wheel having a desired thickness can be easily manufactured.

By properly selecting the tooth shape formed on the toothed wheel blank and the thickness of the toothed wheel, the desired skin-stimulating toothed wheel can be easily manufactured at low cost.

As described above, the present invention provides an instrument for use in a skin-stimulating therapy which can apply a skin-stimulating acupuncturing effect over a wide range of a human skin at a time, thereby achieving high curing effect. By properly changing sharpness of a skin-stimulating toothed wheel, an optimum stimulation can be obtained, depending upon a part of a skin to be stimulated. The toothed-wheel can be easily manufactured by spot-welding process and, therefore, an acupuncturing instrument having a desired sharpness can be easily manufactured at low cost. In the above description a point on a skin is a so-called "tsubo" point and some curing effect can be obtained by applying a mechanical or thermal stimulation to this point.

What is claimed is:

1. An instrument for a skin-stimulating therapy having an effect similar to an acupuncture treatment, comprising:

a plurality of assemblies arranged in parallel relationship to each other, each of said assemblies including:

a plurality of skin-stimulating toothed wheels of the same diameter arranged in parallel relationship with each other, the teeth being rigid and having sharp edges at their ends; and a casing for pivotably supporting each of said assemblies of toothed wheels to allow independent rotation of said toothed wheels;

each of said assemblies of toothed wheels partly projecting said teeth outwardly of said casing to constitute a skin-stimulating acupuncturing assembly;

at least one of said assemblies including stimulating toothed wheels having a tooth shape which is different from that of another assembly.

2. A plurality of assemblies arranged in parallel relationship to each other, each of said assemblies including:

a plurality of skin-stimulating toothed wheels of the same diameter arranged in parallel relationship with each other, the teeth being rigid and having sharp edges at their ends; and a casing for pivotably supporting each of said assemblies of toothed wheels to allow independent rotation of said toothed wheels;

each of said assemblies of toothed wheels partly projecting said teeth outwardly of said casing to constitute a skin-stimulating acupuncturing assembly;

at least one of said assemblies including stimulating toothed wheels having a tooth shape which is different from that of another assembly;

each of said toothed wheels of said assembly comprises a toothed wheel blank formed from a thin plate of hard material, a pair of disc-shaped members having desired thickness, said wheel blank being sandwiched between said disc-shaped members, and means for joining said blank and said disc-shaped members into an integral toothed wheel.

3. An instrument as claimed in claim 2, wherein said means for joining includes spot welds.

4. An instrument for a skin-stimulating therapy according to claim 1, wherein said toothed wheels are arranged on a common shaft, the teeth of said wheels extending and tapering away from said shaft and having convergent sides meeting at said sharp edges.

5. An instrument for a skin-stimulating therapy according to claim 4, wherein a plurality of said assemblies are arranged with the shafts in parallel relationship with each other, each of said toothed wheels having the same diameter and the same tooth shape, said assemblies being arranged in said casing at spaced apart positions along a periphery of said casing.

6. An instrument for a skin-stimulating therapy according to claim 4, wherein said teeth are of rigid material.

* * * * *